US005085597A

United States Patent [19]

Story et al.

[11] Patent Number: 5,085,597

[45] Date of Patent: Feb. 4, 1992

[54] CORROSION PROTECTION APPARATUS

[75] Inventors: Martha F. Story, Atlanta, Ga.; Glen W. Ragland, St. Louis, Mo.; William H. Humphries, Patterson, Calif.; Lowell Koht, Foster City, Calif.; William D. Uken, Fremont, Calif.

[73] Assignee: Raychem Corporation, Menlo Park, Calif.

[21] Appl. No.: 677,021

[22] Filed: Mar. 28, 1991

Related U.S. Application Data

[63] Continuation-in-part of Ser. No. 523,158, May 14, 1990, abandoned, which is a continuation of Ser. No. 398,697, Aug. 25, 1989, abandoned, which is a continuation of Ser. No. 320,351, Mar. 8, 1989, abandoned, which is a continuation of Ser. No. 253,302, Sep. 30, 1988, abandoned, which is a continuation of Ser. No. 183,366, Apr. 12, 1988, abandoned, which is a continuation of Ser. No. 767,555, Aug. 20, 1985, abandoned.

[51] Int. Cl.[5] ..... H01R 13/00

[52] U.S. Cl. ..... 439/521

[58] Field of Search ..... 439/199, 519, 521

[56] References Cited

U.S. PATENT DOCUMENTS

| | | | |
|---|---|---|---|
| 3,219,967 | 11/1965 | King et al. | 439/388 |
| 4,186,986 | 2/1980 | Shoemaker | 439/204 |
| 4,504,699 | 3/1985 | Dones et al. | 174/76 |

*Primary Examiner*—Joseph H. McGlynn

*Attorney, Agent, or Firm*—Dennis E. Kovach; Herbert G. Burkard

[57] ABSTRACT

An apparatus for protecting a substrate includes a collapsible reservoir filled with a three-dimensional elastic gel which is relatively soft and has an ultimate elongation of at least 200%. The apparatus is disposed in contact with a substrate having a recess therein to be environmentally protected, and a force is applied to the reservoir to at least partially collapse the reservoir forcing the gel from an open surface of the reservoir into the recess so as to substantially fill and encapsulate the recess.

20 Claims, 5 Drawing Sheets

CORROSION PROTECTION APPARATUS

This application is a continuation-in-part of copending application Ser. No. 07/523,158, filed on May 14, 1990, now abandoned, which is a continuation of Ser. No. 07/398,697, filed on Aug. 25, 1989, now abandoned, which is a continuation of Ser. No. 07/320,357, filed Mar. 8, 1989, now abandoned, which is a continuation of Ser. No. 07/253,302, filed on Sep. 30, 1988, now abandoned, which is a continuation of Ser. No. 07/183,366, filed Apr. 12, 1988, now abandoned, which is a continuation of Ser. No. 06/767,555, filed Aug. 20, 1985, now abandoned.

BACKGROUND OF THE INVENTION

The present invention relates to apparatuses for protecting substrates against corrosion, electrical currents, and other adverse environmental effects.

Various methods have been proposed in the prior art for protecting a substrate from adverse environmental effects. A typical method used in the prior art is to dispose a viscous grease around the substrate in an attempt to keep adverse environmental contaminants, such as water, from corroding the substrate being protected or providing an electrical path thereto. Another common method used in the prior art has been to apply paint to the substrate. Both of these methods are disadvantageous in that insufficient corrosion protection is afforded, re-entry is difficult, the protection lasts for a relatively short period of time, they are labor intensive, and relatively expensive.

Debbaut, U.S. Ser. Nos. 434,011, 504,000, and 507,433, all assigned to the assignee of the present invention and incorporated herein by reference, disclose various containers which are substantially filled with gel material, the container subsequently being disposed in contact with a substrate subsequent to curing the gel. Though these containers are quite effective in protecting substrates, a problem still exists in the art in providing adequate environmental protection to a substrate having a recess therein since condensation oftentimes can still occur within a void surrounded by the recess, Furthermore, some substrates are disposed. in installations wherein very little room is available for disposing a relatively large gel filled container thereat so as to completely enclose the substrate to be protected with gel.

SUMMARY OF THE INVENTION

Accordingly, it is an object of the invention to eliminate the above-noted drawbacks and to provide an article for protecting a substrate which is relatively inexpensive to produce, is easy to install over the substrate, lasts a relatively long period of time, and can be made easily re-enterable, if desired.

These and other objects are achieved by an apparatus which includes a reservoir filled with a gel, the gel comprising a three dimensional open cell network, the gel being elastic, and having finite elongation characteristics, preferably in excess of 200%, and having a cone penetration between 100 and 350 ($10^{-1}$ mm), more preferably between 200 and 300 ($10^{-1}$ mm), and most preferably between 250 and 280 ($10^{-1}$ mm). The reservoir is collapsible and has an open face through which gel can be disposed outward therefrom when a portion of the reservoir is collapsed such that upon collapsing the reservoir, the gel is dispensed through the open side of the reservoir and into a recess of a substrate to be protected such that the gel can completely fill the recess.

According to an alternative embodiment of the invention, a plurality of reservoirs, either collapsible or non-collapsible, are interconnected by flexible bridging members which allows the use of relatively small reservoirs to be incorporated in an apparatus for protecting a plurality of contact areas on a substrate such that a major portion of the apparatus does not contain gel so as to allow the apparatus to be disposed in installations where very little room is available for protecting the substrate.

DESCRIPTION OF THE PREFERRED EMBODIMENTS

Figure 1:
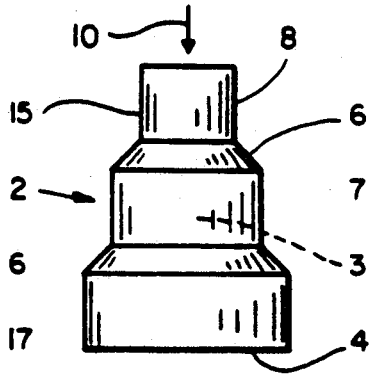
FIGS. 1–4 illustrate various alternative embodiments of collapsible reservoir constructions.

FIGS. 1–4 illustrate various embodiments of a collapsible reservoir 2 constructed in accordance with the teachings of the present invention.

Each of the reservoirs 2 includes a gel 3 therein. The gel is preferably one of the types described in Debbaut, U.S. Ser. Nos. 434,011, filed Nov. 12, 1982; 504,000, filed June 13, 1983; 507,433, filled June 23, 1983; and Chang, U.S. Ser. No. 646,555, filed Oct. 31, 1984; all assigned to the assignee of the present invention. In particular, the gel can comprise a urethane, a silicone, or a non-silicone liquid rubber with low or no unsaturation which has been crosslinked, with urethanes and silicones being preferred embodiments. The gel is a material having an open loop three-dimensional network such that it is elastic and has a finite amount of elongation, and is relatively soft. A preferred embodiment is to use a gel having a cone penetration between 100 and 350 ($10^{-1}$ mm), and an ultimate elongation of at least 100%, as measured in accordance with American National Standard Designation ASTM-D217 and ASTM-D638, respectively. Preferably, the cone penetration is between 200 and 300 ($10^{-1}$ mm), and more preferably between 250 and 280 ($10^{-1}$ mm). In addition, the ultimate elongation is also more preferably in excess of 200%, the more preferably in excess of 500%. In addition, the gel is also preferably elastic such that it tends to resist deformation and generates a restoration force upon being deformed.

Figure 2:
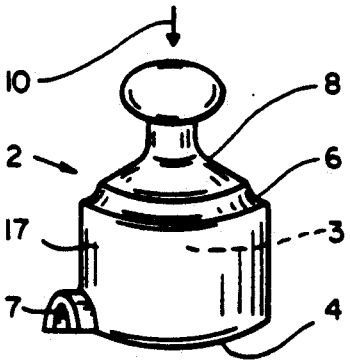

The reservoir 2 is collapsible such that when subjected to a force indicated by arrow 10, the gel 3 within the reservoir 2 is displaced out of the reservoir through an open side 4 thereof as illustrated in FIGS. 1–4. In FIG. 2, an open side 7 having a tunnel cross-sectional configuration is formed on a side of the collapsible reservoir 2, this embodiment allowing a substrate to be protected to be inserted and/or removed from the reservoir from its side. In addition, it is preferable that the gel have an ultimate elongation sufficiently large such that the gel does not tear when the reservoir collapses.

Preferably, the collapsible container 2 is made of a material, or has an internal construction such that, the gel 3 has an adhesion strength thereto greater than the gels cohesive strength, with the adhesive strength of the gel to the substrate contact area is intended to protect being preferably less than its cohesive strength and its adhesive strength to the substrate member, to facilitate re-entry.

Figure 3:
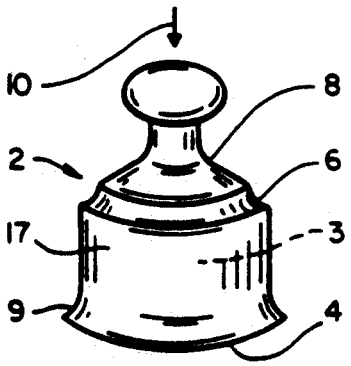

In the embodiment of FIG. 1, the open side 4 is substantially circular in configuration, though elliptical, rectangular, or other shapes can be used where the substrate contact area to be protected is similarly shaped. In the embodiment of FIG. 3, the open side 4 has a tapered skirt construction which has the advantage of enlarging a substrate contact area which can be surrounded and protected while minimizing a volume of the gel 3 required to fill the collapsible reservoir 2.

Figure 4:
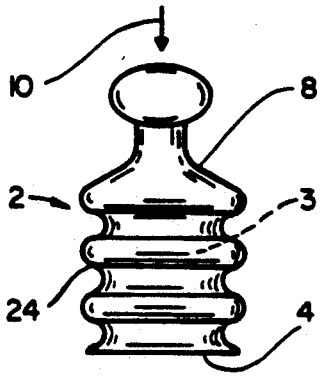

Each of the embodiments of FIGS. 1-4 utilizes a collapsible reservoir 2 which collapses downward, with the embodiment of FIG. 1 having a telescopic profile having a largest cross-sectional area thereof forming the open side through which the gel is dispensed, with a next smaller cross-sectional area 7 being adjacent thereto, with the smallest cross-sectional area 15 being on an opposite end of the reservoir than is the open side 4, as illustrated. Accordingly, if subjected to a force 10, the reservoir collapses such that the section 15 can be received within the section 7 which can be received within the section 17, if total collapsibility is a design criterion. Alternatively, the reservoir can be constructed such that only the section 15 collapses within the section 7. Upon collapsing, this section 15 acts substantially like a piston, this being the mode of collapsing in the embodiments of FIGS. 2 and 3 wherein piston section 8 collapses within larger section 17 formed so as to define the open side 4, 7. In the embodiment of FIG. 4, the collapsible reservoir 2 has a corrugated outer surface 24 which allow an accordian-type compression to occur when subjected to a force 10 so as to dispense gel out of the open side 4. Each of the embodiments of FIGS. 1-4 functionally allows a gel to be dispensed from the reservoir 2 upon being subjected to a force 10 such that the gel is available for filling a recess on a substrate having a contact area incorporating a recess to be protected.

Figure 5:
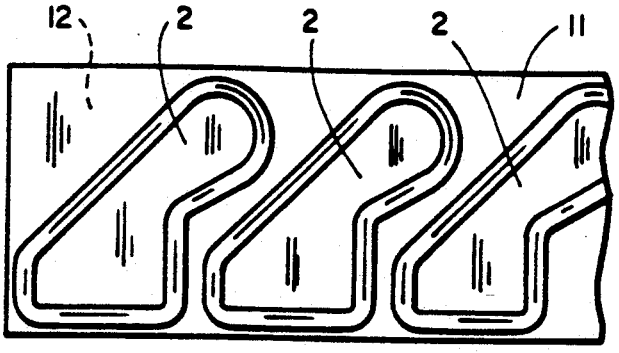
FIG. 5 is a plan view.
Figure 6:
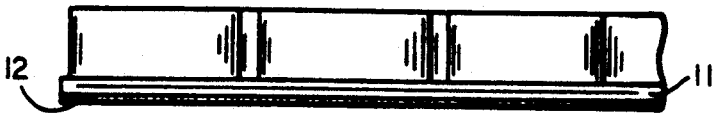
FIG. 6 is a side view, of a plurality of collapsible reservoirs disposed on an apparatus for protecting a plurality of contact areas of a substrate.

The remaining figures illustrate practical embodiments of the invention, with FIG. 5 illustrating a plurality of collapsible reservoirs 2 disposed in line on a strip 11, with the strip 11 having a pressure sensitive adhesive 12 on a surface thereof. In use, the strip 11 is disposed in contact with a substrate having a plurality of contact areas thereon to be protected such that the collapsible reservoirs 2 respectively line up with respective contact areas to be protected, and then the collapsible reservoir is subjected to a force causing the reservoirs to at least partially collapse so as to partially dispense gel therefrom so as to totally incapsulate the contact areas to be protected.

Figure 11:
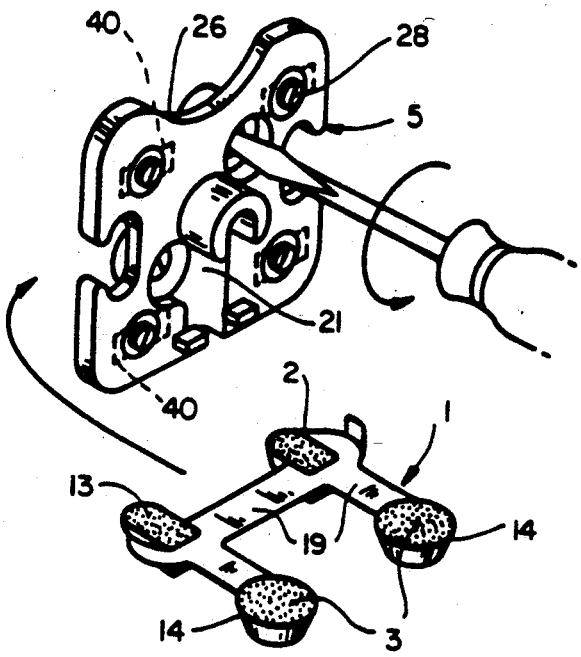
FIG. 11 illustrates yet a further embodiment for protecting contact areas on a modular phone jack, with FIGS. 12–16 illustrating various installation steps of the embodiment of FIG. 11.

A practical embodiment of the invention will next be described with reference to a substrate corresponding to a telephone modular jack 5, illustrated in FIGS. 11-16. Referring to FIG. 11, the apparatus 1 includes first and second collapsible reservoirs 2 and third and fourth reservoirs 14, the reservoirs 14 being either collapsible or noncollapsible, though in the embodiment shown the reservoirs 14 do not need to be collapsible. The reservoirs 2 each have a substantially rectangular cross-sectional profile 13, since a recess 40 on a back side 26 of the jack 5 also has a rectangular cross-sectional profile. The recess on the back side 26 of the jack 5 corresponds to a cavity through which contact screws or bolts 28 extend, the screws 28 being held in place by a metallic mounting bracket 43, shown in FIG. 16. To environmentally protect the contents of the jack 5, the screws 28 and brackets 43 must all be protected.

Figure 12:
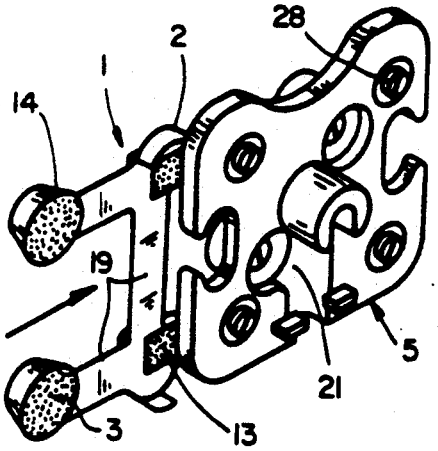
Figure 13:
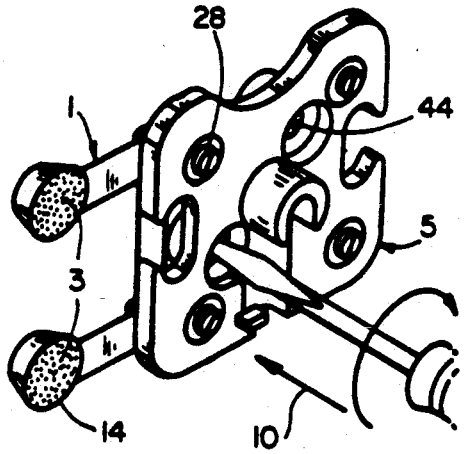
Figure 14:
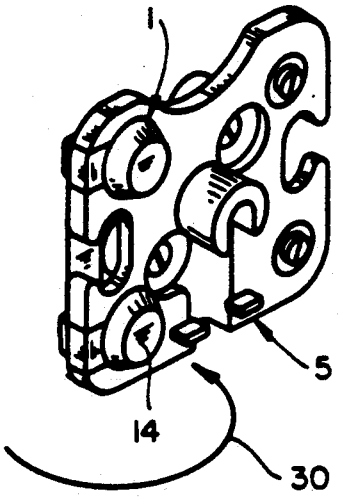
Figure 16:
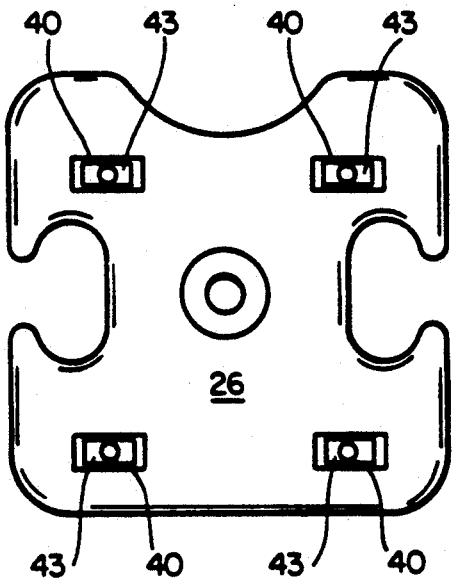

The apparatus 1 further includes flexible briding members 19 interconnecting each of the reservoirs 2, 14. To install the apparatus 1 on the phone jack 5 so as to protect contact bolts 28 and brackets 43 and areas therearound from corrosion and various environmental contaminants, the jack is first loosened from its mounting surface, such as a wall, as illustrated in FIG. 11. Subsequently, the collapsible reservoirs 2 are slid behind the jack 5 as illustrated in FIG. 12 such that the rectangular cross-sectional profiles 13 of the collapsible reservoirs 2 are disposed over recess contact areas 40 on the back side 26 of the jack 5, as illustrated in FIG. 12 and 16, and subsequently the phone jack is re-secured to its mounting surface. Thereafter, the additional reservoirs 14 are wrapped around the jack 5 as illustrated by arrow 30 in FIG. 14 and disposed over ends of the contact screws or bolts 28. In this embodiment, it is not necessary to completely remove the jack 5 from its mounting surface to install the collapsible reservoirs around the recesses, though the jack can be so removed if desired. Rather, all that is required is that the jack be loosened enough so that the reservoirs 2 can be slid behind the jack. Resecuring the jack 5 tightly to its mounting surface by tightening screws 44 as illustrated in FIG. 13 provides the force means 10 for collapsing the reservoirs 2.

Figure 15:
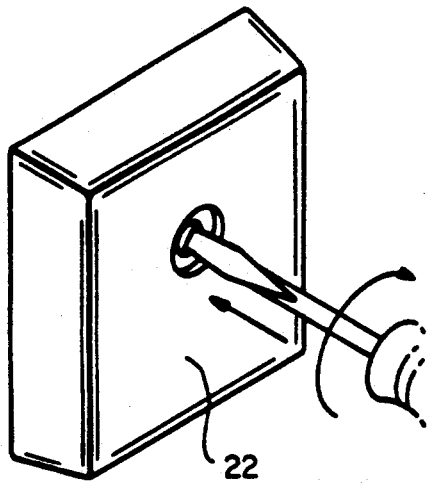

Since the screws or bolts 28 protrude from a front surface of the jack 5, the gel 3 is readily elastically displaced around ends of the screws or bolts 28 and maintained in close and conforming contact therewith so long as held under some force by some additional force means 10', this force means being provided by jack cover 22 which is screwed over the phone jack 5, as illustrated in FIG. 15. Preferably, the gel has a tacky surface so as to facilitate adhesion of the gel to the contact area of the substrate to be protected while being held under compression.

The embodiment of FIGS. 11-16 is further advantageous in that a plurality of the reservoirs 2, 14 are interconnected by flexible bridging members 19 which allows a plurality of substrate contact areas to be protected utilizing a minimum amount of gel with the apparatus 1 occupying a minimum amount of room, as compared to other prior art constructions wherein relatively large reservoirs 2 are provided for enclosing entire substrates so as to protect various contact areas thereon.

Figure 7:
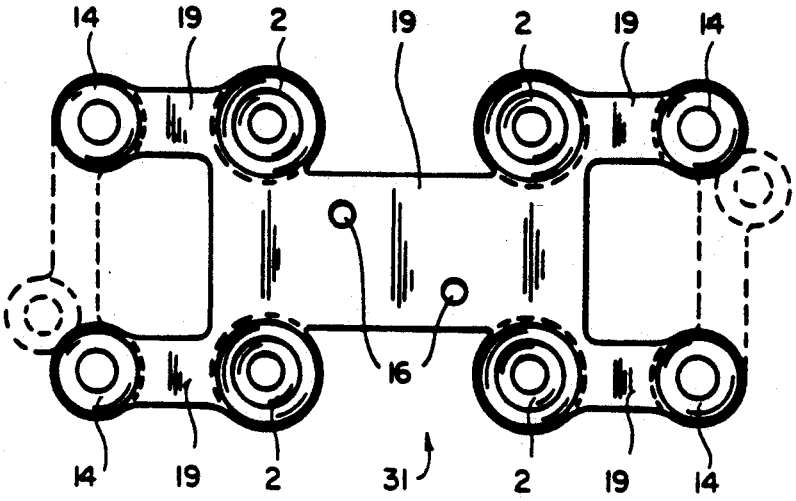
FIG. 7 is a plan view.
Figure 8:
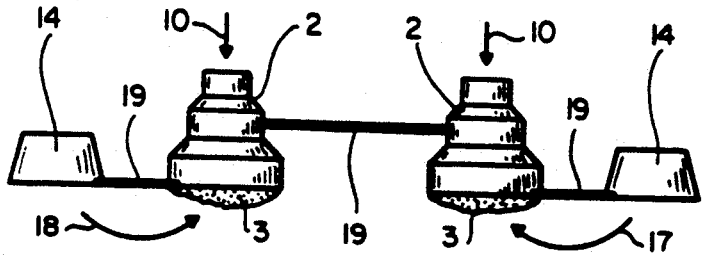
FIG. 8 is an end view of one preferred embodiment of the invention, this embodiment being particulary useful for protecting contact areas on a modular telephone jack.

FIGS. 7-10 illustrate further alternative embodiments of the invention. In the embodiment of FIGS. 7 and 8, the apparatus 31 includes flexible bridging members 19 arranged such that eight reservoirs in total are included with the apparatus. In use, the jack 5 is removed from its mounting surface rather than simply loosened as in the embodiment of FIGS. 11-16, and the apparatus 31 is disposed on the mounting surface such that the reservoirs 2 are disposed at a location such that they will come in contact with substrate recess contact areas 40 to be protected when the jack 5 is replaced on the mounting surface, with holes 16 being provided on the flexible bridging member for providing a means of properly orienting the apparatus 31, and in particular the rectangular shaped open sides 13 of the collapsible reservoirs 2. The holes 16 will line up with attachment holes 21 (FIG. 11) through which screws extend for attaching the phone jack 5 to its mounting surface and providing a force means 10. The force means 10 causes the reservoirs to collapse, as previously explained. Subsequent to re-attaching the phone jack to its mounting surface, reservoirs 14 are pivoted about a 180° semicircle in a manner similar to that illustrated by arrow 30 in FIG. 14 so as to cover all the exposed and protruding contact screws or bolts 28. The embodiment of FIG. 3 is particularly advantageous in that it comprises only a single article, is easily installable, and provides an indication means 16 confirming proper orientation of the apparatus. In the apparatus of FIG. 11-14, orientation indication means is provided by the shape of the rectangular shaped open sides 13 of the reservoirs 2 which corresponds to the rectangular shape of the contact areas 40.

Figure 9:
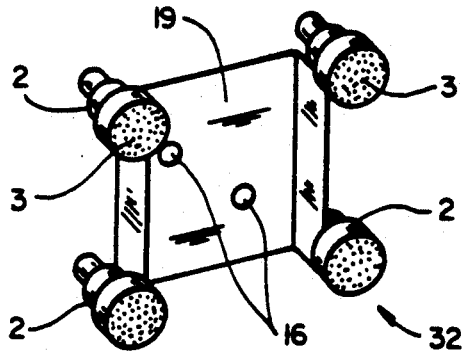
FIGS. 9 and 10 illustrate an alternative embodiment for protecting contact areas on a modular phone jack.
Figure 10:
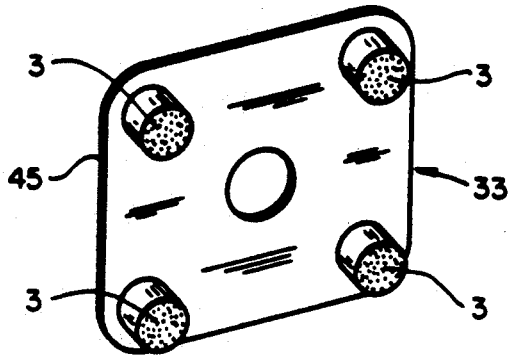

The embodiment of FIGS. 9 and 10 comprises first and second pieces 32, 33, with the first piece 32 containing a plurality of collapsible reservoirs 2 having the gel 3 disposed therein, the piece 32 being adapted for being located on the back side 26 of phone jack 5 after its removal such that upon re-attachment of the phone jack 5 each of the reservoirs 2 is collapsed so as to exert gel therfrom into contact area recesses 40 on the back side of the phone jack 5. Subsequently, the piece 33 is disposed over the front side of the phone jack so as to encapsulate each of the bolts or screws 28, with the force means to the piece 33 being preferably provided by pressure sensitive adhesive 45 located on a side of the piece 33 in contact with the jack 5. Additional force means can also be provided by re-attaching the cover 22, as illustrated in FIG. 15.

The embodiment of FIGS. 9 and 10 is advantageous in that relatively few pieces are required to adequately protect a phone jack, indication means is provided to facilitate proper installation thereof, and a plurality of reservoirs are interconnected with flexible bridging members thus reducing the component parts required to adequately protect the phone jack 5.

It is to be understood that the inventions of providing collapsible reservoirs are useful in a wide variety of applications, and not specifically limited to the particular application of protecting a phone jack, as described herein, and that the invention of providing a plurality of small reservoirs interconnected by flexible briding members so as to allow encapsulation of opposite surfaces of a substrate 5 in a fast and efficient manner is also not limited only to the embodiment of the protection of phone jack 5. The invention is particularly applicable to any application where a substrate has a contact area which has a recess which requires protection, or in any application where it is desired that gel be pumped into a location relatively remote from a surface of the substrate to which the reservoir is attached, the invention also being useful in any application where opposite sides of a substrate need to be protected in a fast and efficient manner. Accordingly, the invention is to be limited only by the appended claims.

What is claimed is:

1. An apparatus for protecting a substrate, comprising:

a first reservoir; and an elastic gel having a cone penetration value between 100 and 350 ($10^{-1}$ mm) and an ultimate elongation of at least 200%, the gel being contained within the reservoir prior to contacting the substrate;

means for pumping at least some of the gel out of the reservoir and in contact with the substrate so as not to exceed the ultimate elongation of the gel and so as to at least partially collapse the reservoir.

2. The apparatus of claim 1, further comprising means for supporting the reservoir, and a pressure sensitive adhesive disposed on the supporting means, 3. The apparatus of claim 1, the reservoir having an open side through which the gel is dispensed outward therefrom when a portion of the reservoir is collapsed.

4. The apparatus of claim 3, the reservoir having a telescopic profile extending from the open side thereof such that a cross-sectional area of the reservoir in a vicinity of the open side is larger than a cross-sectional area of the reservoir in a vicinity remote from the side thereof.

5. The apparatus of claim 3, the reservoir having a structural strength such that when subject to an axial force the reservoir first collapses in a region remote from the open side, the reservoir collapsing in a piston-like manner.

6. The apparatus of claim 5, a cross-sectional area of the open side being substantially smaller than a cross-sectional area of the reservoir.

7. The apparatus of claim 3, further comprising a substrate having a recess therein, the reservoir having the gel therein being disposed on the substrate such that the open side of the reservoir faces the recess.

8. The apparatus of claim 7, the substrate comprising a modular telephone jack, the reservoir being disposed on a wall side of the jack confronting an end of a contact screw and mounting means therefor.

9. The apparatus of claim 8, further comprising second, third and fourth reservoirs filled with the gel, the reservoirs being interconnected by flexible bridging members and each having an open side, the pumping means pumping at least some of the gel out of the second, third and fourth reservoirs and in contact with the substrate so as not to exceed the ultimate elongation of the gel and so as to at least partially collapse the second, third and fourth reservoirs, the second, third and fourth reservoirs each being disposed over the wall side of the jack.

10. The apparatus of claim 3, further comprising second, third and fourth reservoirs filled with the gel, the reservoirs being interconnected by flexible briding members, and each having an open side.

11. The apparatus of claim 10, the pumping means pumping at least some of the gel out of and in contact with the substrate so as not to exceed the ultimate elongation of the gel and so as to at least partially collapse the second, third and fourth reservoirs.

12. The apparatus of claim 10, the second reservoir being collapsible, the bridging members being flexible enough to allow the third and fourth reservoirs to be moved from a first position whereat their respective open surfaces lie in a substantially common plane with the open surface of the first and second reservoirs to a second position whereat the open sides of the third and fourth reservoirs confront the open sides of the first and second reservoirs.

13. The apparatus of claim 12, the substrate comprising a modular telephone jack, the first and second reservoirs being disposed on a wall side of the jack such that the open sides of the reservoirs confront recesses on the wall side of the jack, and further comprising force means for at least partially collapsing the first and second reservoirs so as to pump gel through the open sides thereof and into the recesses, the third and fourth reservoirs being disposed opposite the first and second reservoirs on a front side of the jack.

14. The apparatus of claim 13, further comprising fifth, sixth, seventh and eighth reservoirs and means for interconnecting the fifth, sixth, seventh and eighth reservoirs to the first, second, third and fourth reservoirs, at least four of the reservoirs being collapsible.

15. The apparatus of claim 14, the interconnecting means including means for aligning the reservoirs with the recesses.

16. An apparatus for protecting a substrate, comprising:

first, second, third and fourth reservoirs;

an elastic gel having a cone penetration between 100 and 350 ($10^{-1}$ mm) and an ultimate elongation of at least 200%, the gel being contained within the reservoirs;

means for flexibly interconnecting the reservoirs such that the third and fourth reservoirs can be moved from a first position whereat an open side of each of the reservoirs lies in substantially a common plane to a second position whereat the open sides of the third and fourth reservoirs confront the open sides of the first and second reservoirs.

17. The apparatus of claim 16, further comprising fifth, sixth, seventh and eighth reservoirs filled with gel, means for interconnecting the fifth, sixth, seventh and eighth reservoirs to the first, second, third and fourth reservoirs such that the seventh and eighth reservoirs can be moved from a third position whereat their respective open sides lie in substantially a common plane with open sides of the fifth and sixth reservoirs to a fourth position wherein the open sides of the seventh and eighth reservoirs confront the open sides of the fifth and sixth reservoirs.

18. The apparatus of claim 17, further comprising means for aligning the reservoirs with contact areas on the substrate to be protected.

19. The apparatus of claim 18, the substrate comprising a modular telephone jack having four recesses on a wall side thereof into which contact screws extend from the front side of the phone jack.

20. An apparatus for protecting a modular telephone jack, comprising:

a first member having first, second, third and fourth reservoirs therein;

an elastic gel having a cone penetration between 100 and 350 ($10^{1}$ mm) and an ultimate elongation of at least 200%, the gel being contained within the reservoirs; and a pressure sensitive adhesive located on a face of the first member which bonds the first member to a modular telephone jack such that the gel is deformed and held in close and conforming contact with contact surfaces on the jack.

* * * * *